US005954620A

United States Patent [19]

Albritton

[11] Patent Number: 5,954,620

[45] Date of Patent: Sep. 21, 1999

[54] COMBINATION BENCH PRESS AND SIT-UP BOARD TRANSFORMABLE INTO A SOFA

[76] Inventor: Kenneth B. Albritton, 1419 Hopeful Rd., Montpelicr, Va. 23192

[21] Appl. No.: 09/162,137

[22] Filed: Sep. 29, 1998

[51] Int. Cl.[6] ..... A63B 21/078

[52] U.S. Cl. ..... 482/104; 482/142

[58] Field of Search ..... 482/104, 142, 482/83, 108

[56] References Cited

U.S. PATENT DOCUMENTS 4,805,901 2/1989 Kulick .
4,838,547 6/1989 Sterling .
5,306,220 4/1994 Kearney .
5,611,762 3/1997 Kaye .

FOREIGN PATENT DOCUMENTS 1017722 12/1952 France ..... 482/142

*Primary Examiner*—John Mulcahy
*Attorney, Agent, or Firm*—Robert E. Bushnell, Esq.

[57] ABSTRACT

A bench press and sit-up board that is transformable into a sofa. By attaching a sit-up board to the bar supporting structure the backrest of the sofa is formed. The bar supporting structure can be reattached to the side of the body supporting structure to form the back of the sofa. Then Velcro attachments and pads, along with throws and pillows, can be attached to form an aesthetic sofa. This allows people having limited space in the home to keep a bench press in the home.

22 Claims, 10 Drawing Sheets

COMBINATION BENCH PRESS AND SIT-UP BOARD TRANSFORMABLE INTO A SOFA

BACKGROUND OF THE INVENTION

1. Field of the Invention

The present invention relates to exercise equipment and, more specifically, to a bench press that can be transformed into a sofa.

2. Background Art

Developing a personal weight lifting routine has become more common today as the benefits of resistance exercises have become increasingly documented by specialists in the medical profession. Weight lifting has been shown to prevent the loss of bone mass as well as allowing one to enjoy a higher quality of life during later years. This is one of many factors that has contributed to the growing amount of exercise equipment that is found in homes today. Especially useful in developing muscle mass and preventing loss of bone mass is any exercise that stresses a major muscle group, such as the thighs, chest, or back. As such, the fact that the bench press primarily develops the chest muscles makes it particularly suited for obtaining health benefits.

While working out at home offers the advantages of convenience and privacy, space that can be used only for exercise equipment is limited. Thus, people who would otherwise purchase high quality exercise equipment elect instead to use a gymnasium. This has led manufacturers of exercise equipment to constantly work at developing new designs for equipment that is both functional, effective, but not overly burdensome in the amount of space used. Some equipment that has been developed is shown, by way of example, in U.S. Pat. No. 5,306,220 to Kearney entitled *Knock-Down Weight-Lifting Frame and Exercise System,* U.S. Pat. No. 5,611,762 to Kaye entitled *Convertible Work-out Bench-Coffee Table,* U.S. Pat. No. 4,838,547 to Sterling entitled *Indoor Outdoor Exercise Chair,* and U.S. Pat. No. 4,805,901 to Kulick entitled *Collapsible Exercise Device.*

While the bench presses of the contemporary art are a fundamental piece of weight lifting equipment for developing upper body mass and strength, the bench press takes up a significant amount of room in the home when it is not in use. This has reduced the number of consumers who have purchased bench presses for their home despite its advantages for developing one's overall physique. I believe it may be possible to improve on the art by providing a bench press that does not waste space when not in use. This would increase the demand for bench presses in the home and increase the market competitiveness of bench presses.

SUMMARY OF THE INVENTION

Accordingly, it is an object of the present invention to provide an improved bench press.

It is another object to provide a bench press that does not waste space in the home while not in use.

It is still another object to provide a bench press that can combine with a sit-up board to form a sofa.

It is yet another object to provide a bench press with increased market competitiveness.

To achieve these and other objects a bench press is provided having two basic components, a body supporting structure and a bar supporting structure. The two components can be combined to be used as a classical bench press or be transformed, with the addition of a sit-up board, into a sofa.

The bar supporting structure may be constructed using two bases that support two vertical members. Both vertical members have weight bearing arms that allow a weighted bar to be held above a user's head. The two vertical members are joined by a traversing member. The bases may be constructed out of members that distribute force from the vertical members over a wider area along the ground. Each member used as a base is oriented in a plane formed by the vertical member it supports and the corresponding weight bearing arm.

The body supporting structure may be constructed using a cushioned board that allows a user to recline while manipulating weights supported by a stand. The stand may be constructed using one or two vertical members each supported by a base. The one or two vertical members are joined by a traversing member that runs the length of the cushioned board. The traversing member for the cushioned board is wider than the vertical supports to give lateral stability during the performance of resistance exercises. The bench is fastened to the traversing member through holes in the member. The bases of the body supporting structure may be constructed using members that run along the ground perpendicularly to the length of the cushioned board. All of the members may be constructed of circular, rectangular, or square tubing. The bar supporting structure is connected to the body supporting structure by sliding the body supporting structure over the cross bar between the two vertical members so that the traversing member of the bar supporting structure is adjacent to the traversing member of the body supporting structure. These may be secured using a hand tightened bolt. After making this adjustment the exercise apparatus can be used as a bench press.

To transform the bench press to a sofa, the bar supporting structure is reduced in height by removing an upper section of the two vertical members or lowering the section inside the slightly larger lower vertical members. The body supporting structure is turned so the two vertical members of the bar supporting structure are each aligned with one of the bases of the body supporting structure. At the bottom of the members supporting the bar supporting structure are projections that are slightly smaller than the dimensions of the base members. These projections fit inside of hollows that are in the base members of the body supporting structure. Once the two components are connected in their new configuration a sit up board is attached to the vertical members of bar supporting structure to form a backrest. The sit-up board is attached using straps or clips that are attached to the back of the sit up board to connect to the two vertical members of the bar supporting structure. Thus, the bench press is transformed into a sofa.

This inventive bench press not only fulfills its function as a traditional piece of resistance exercise equipment but also avoids wasting usable space when one is not exercising. With the clever use of throw pillows or covers, a bench press machine can now be transformed into aesthetically pleasing furniture. This will allow people who do not have the space for a bench press to incorporate one into their living environment. For example, a bench press could now replace a sofa, reading chair, or loveseat.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
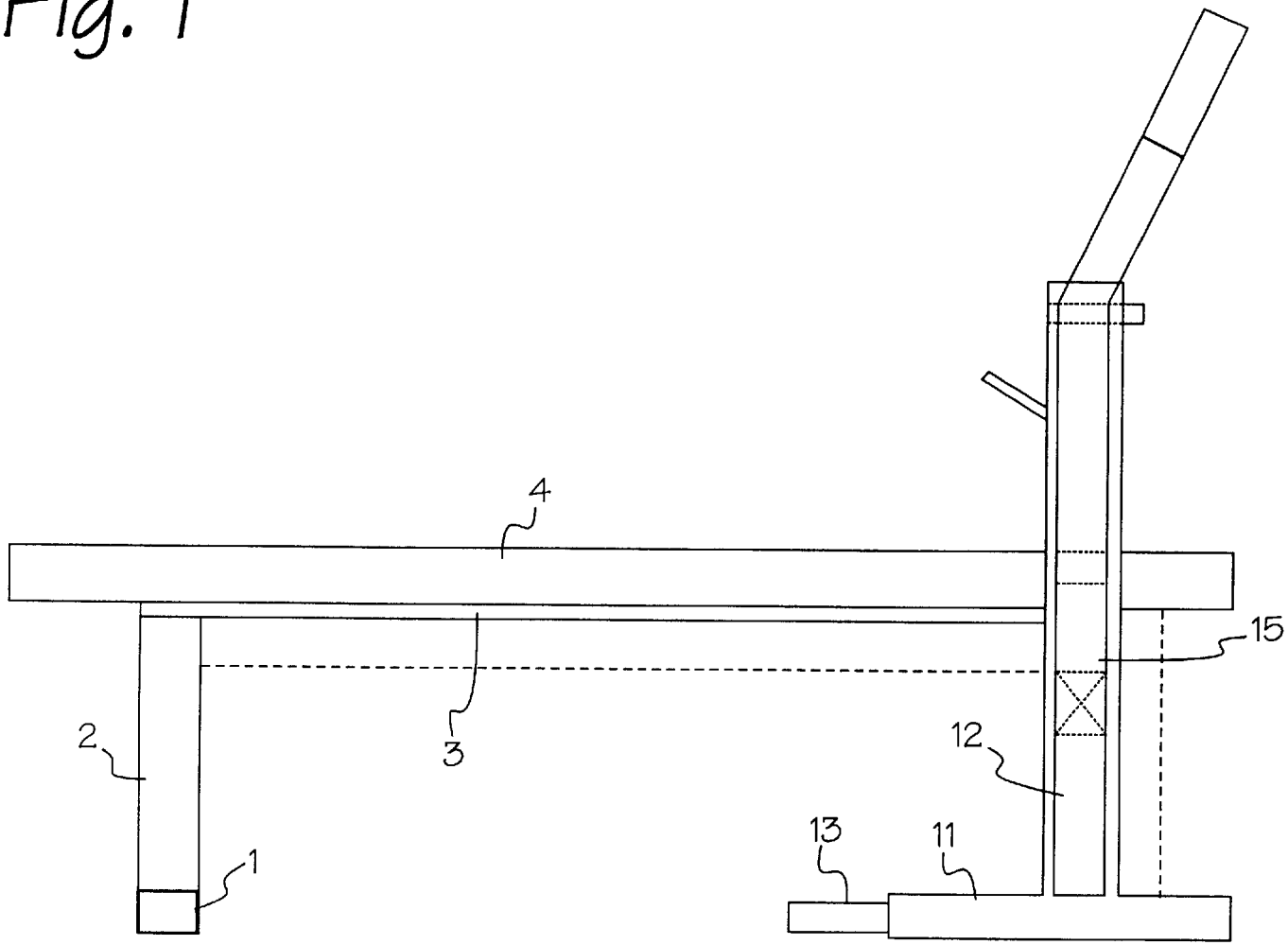
FIG. 1 is a side view of a bench press, as constructed according to the principles of the present invention, with both the body supporting structure and the bar supporting structure combined to form a traditional bench press.

Turning now to the drawings, FIG. 1 illustrates a bench press as constructed according to the principles of the present invention. Both the body supporting structure and the bar supporting structure are connected to form a traditional bench press device. The body supporting structure has cushioned board 4 for a user to recline on while working with various weights. Cushion 4 is fastened to body traversing member 3 using fastening holes (not shown). Body traversing member 3 is welded or comparably attached to body vertical supports 2. All of the members may be constructed out of square, circular, or rectangular tubing. The body vertical supports are attached to bases 1 that rest on the ground. The bases may be constructed using members oriented perpendicularly to the length of the board. This orientation of bases 1 provides lateral support for the bench press and user.

The bar support structure, as also shown in FIG. 1, may be constructed using two bar vertical supports 12, that are supported by bases 11. The two bar vertical supports are connected by bar traversing member 15. Bases 11 may be constructed usingly members oriented perpendicularly to the plane of the bar vertical supports and the bar traversing member. Each base 11 has projection 13 that is insertable into hollows in bases 1 of the body supporting structure.

Figure 2:
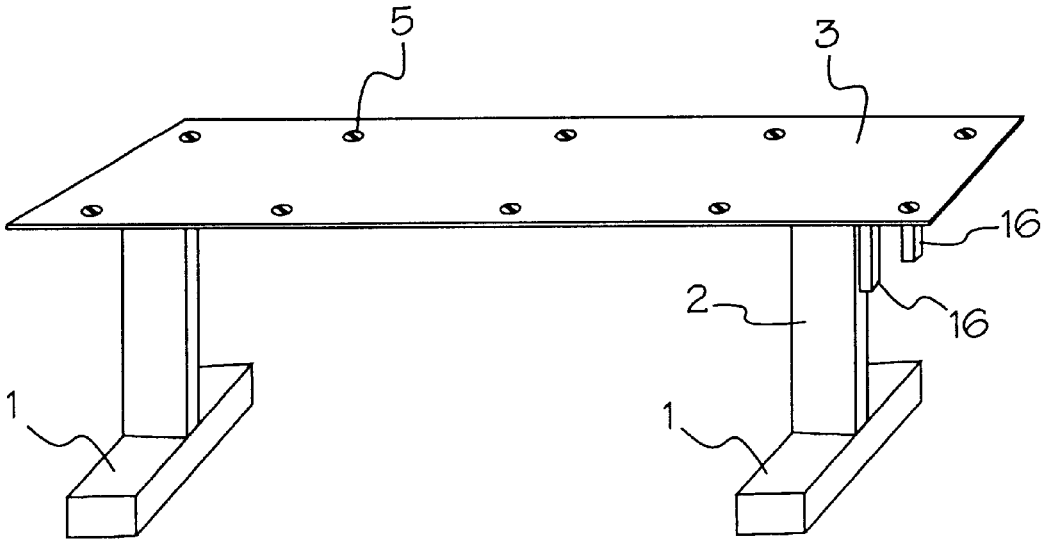
FIG. 2 is a perspective view of just the members of the body supporting structure of FIG. 1.
Figure 2A:
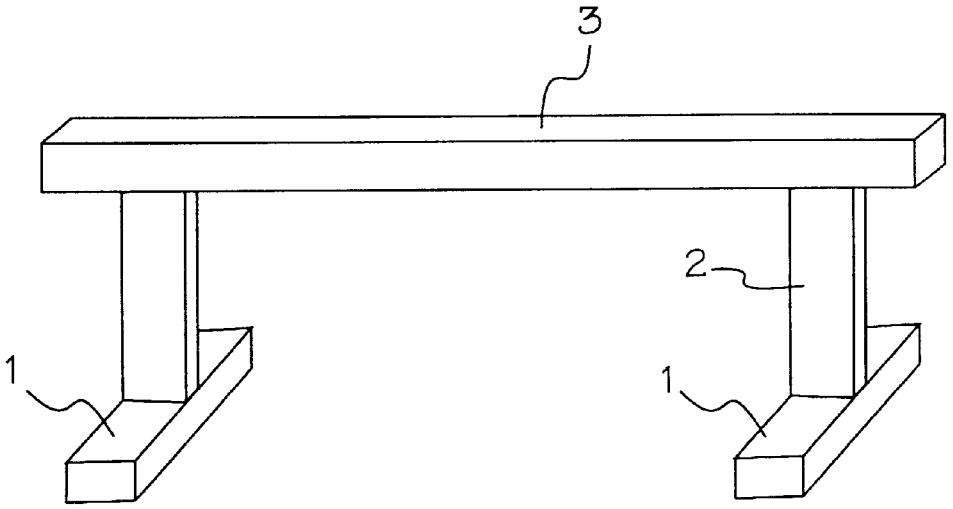
FIG. 2*a* is a perspective view of just the members of an alternative body supporting structure to that of FIG. 2.

The body supporting structure is shown in FIG. 2 without the cushioned board. Body traversing member 3 is shown supported by body vertical supports 2 that are, in turn, supported by bases 1. Body traversing member has a plurality of fastening holes that are used to fasten the cushioned board to the body supporting structure. First a board is fastened to body traversing member 3 and secured with fasteners. The fasteners used to secure the board to body traversing member can be any one of a bolt, screw or rivet. Then, a foam-like padding is placed on the board and covered with a durable material. The durable material is then pulled around the board and attached to the underside of the board. The durable material can be fastened using either staples, glue, or both. An alternative body supporting structure is shown in FIG. 2*a*. Bases 1 support body vertical supports 2 that are attached to body traversing member 3.

Figure 3:
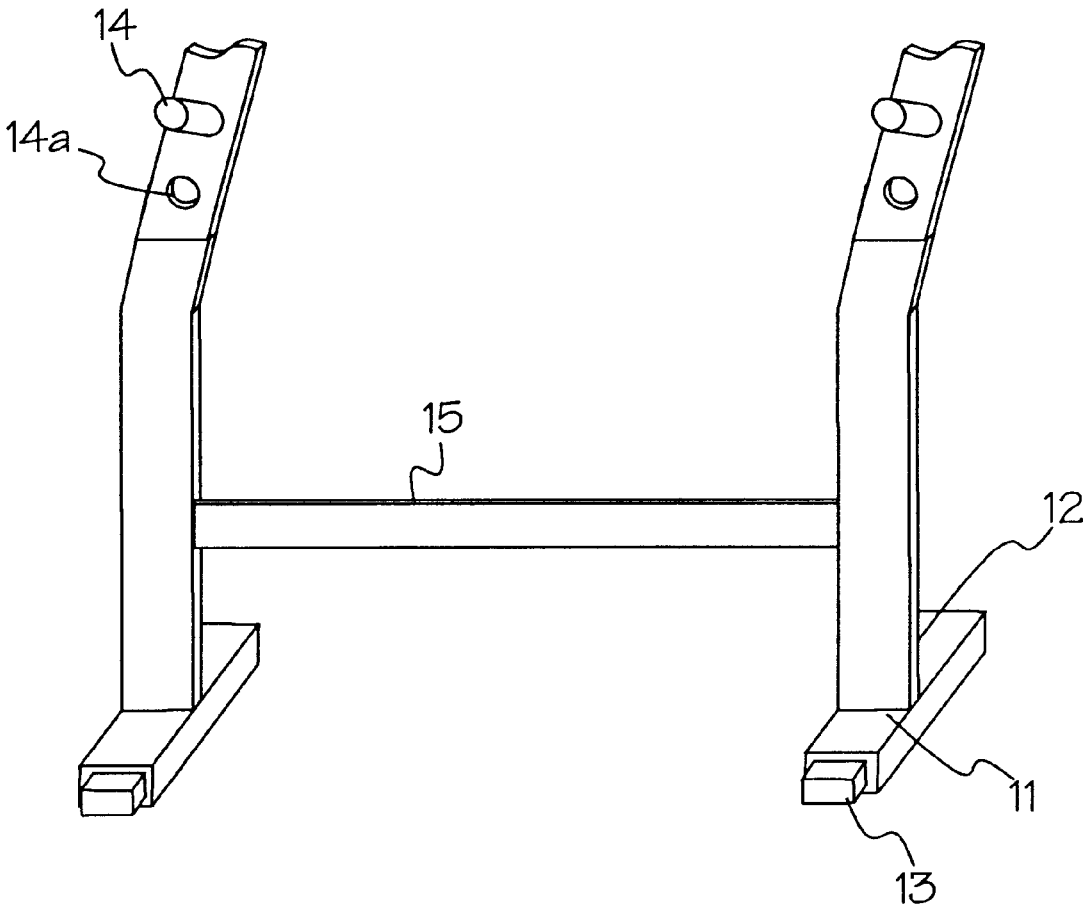
FIG. 3 is a perspective view of the bar supporting structure.

The bar supporting structure is illustrated alone in FIG. 3. The weighted bar for use in performing resistance exercises is kept on weight bearing arms 14. Weight bearing arms 14 are inserted into drilled holes 14*a* in the vertical supports and may be removed when attaching the backrest. Bases 11 support bar vertical supports 12 and have projections 13 that insert into hollows (not shown) in bases 1 of the body supporting structure (not shown).

Figure 4A:
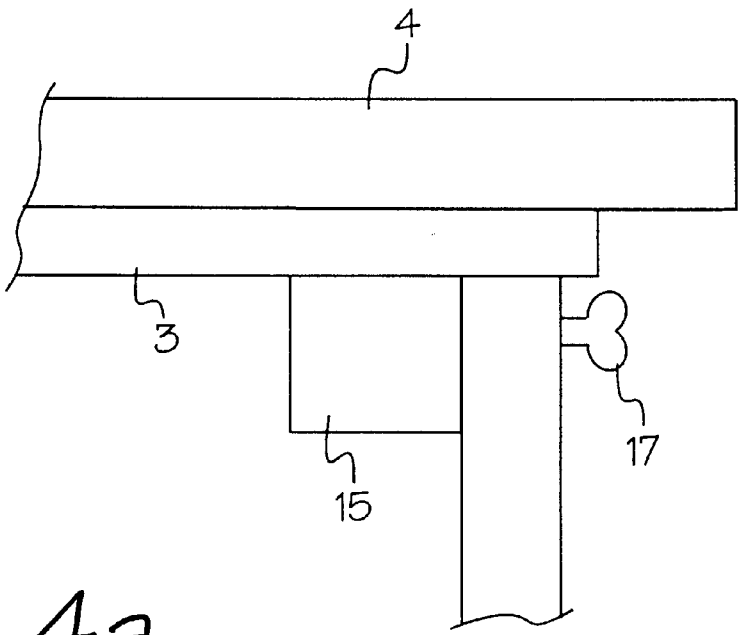
FIG. 4*a* is a perspective view of a second method for securing the bar supporting structure to the body supporting structure.
Figure 4:
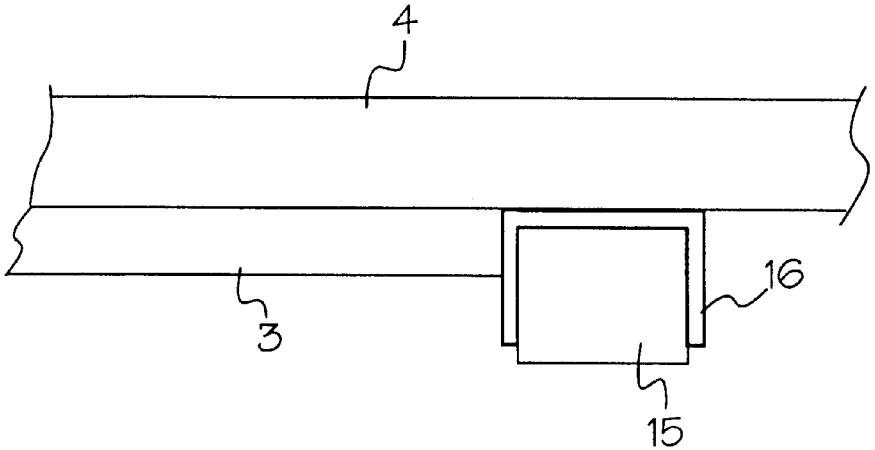
FIG. 4 is a side view illustrating the connection between the bar supporting structure and the body supporting structure.
Figure 4B:
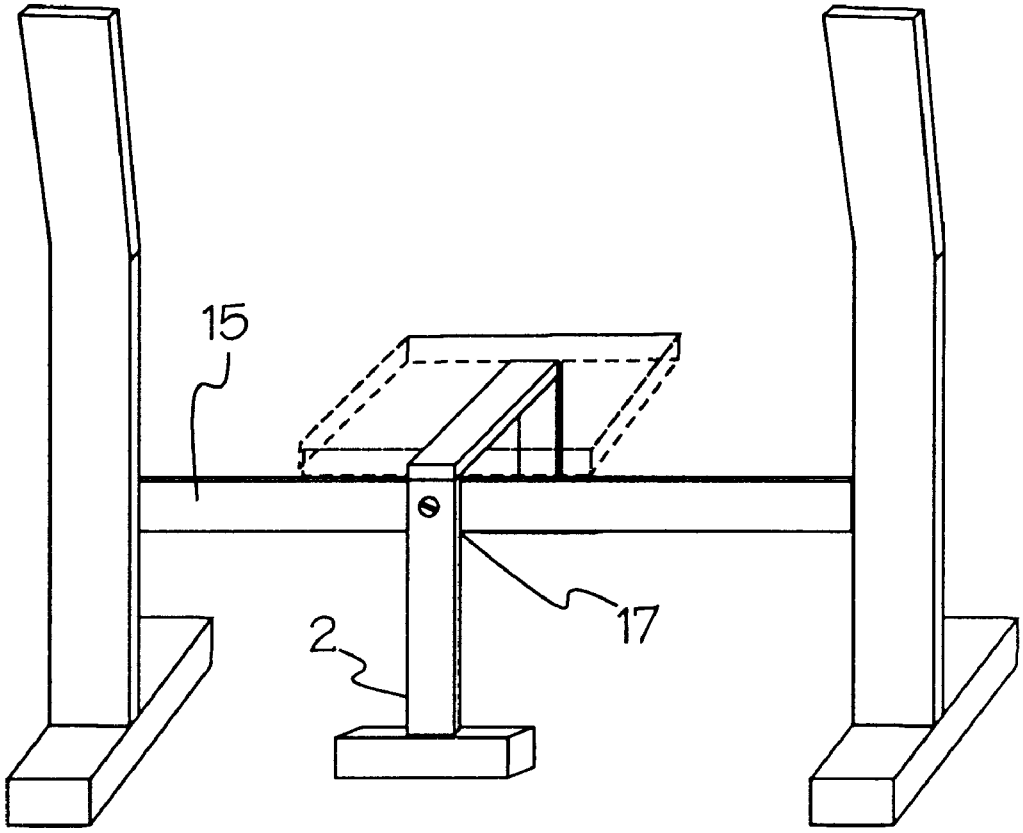
FIG. 4*b* is a rear perspective view of a third method for securing the bar supporting structure to the body supporting structure.
Figure 9:
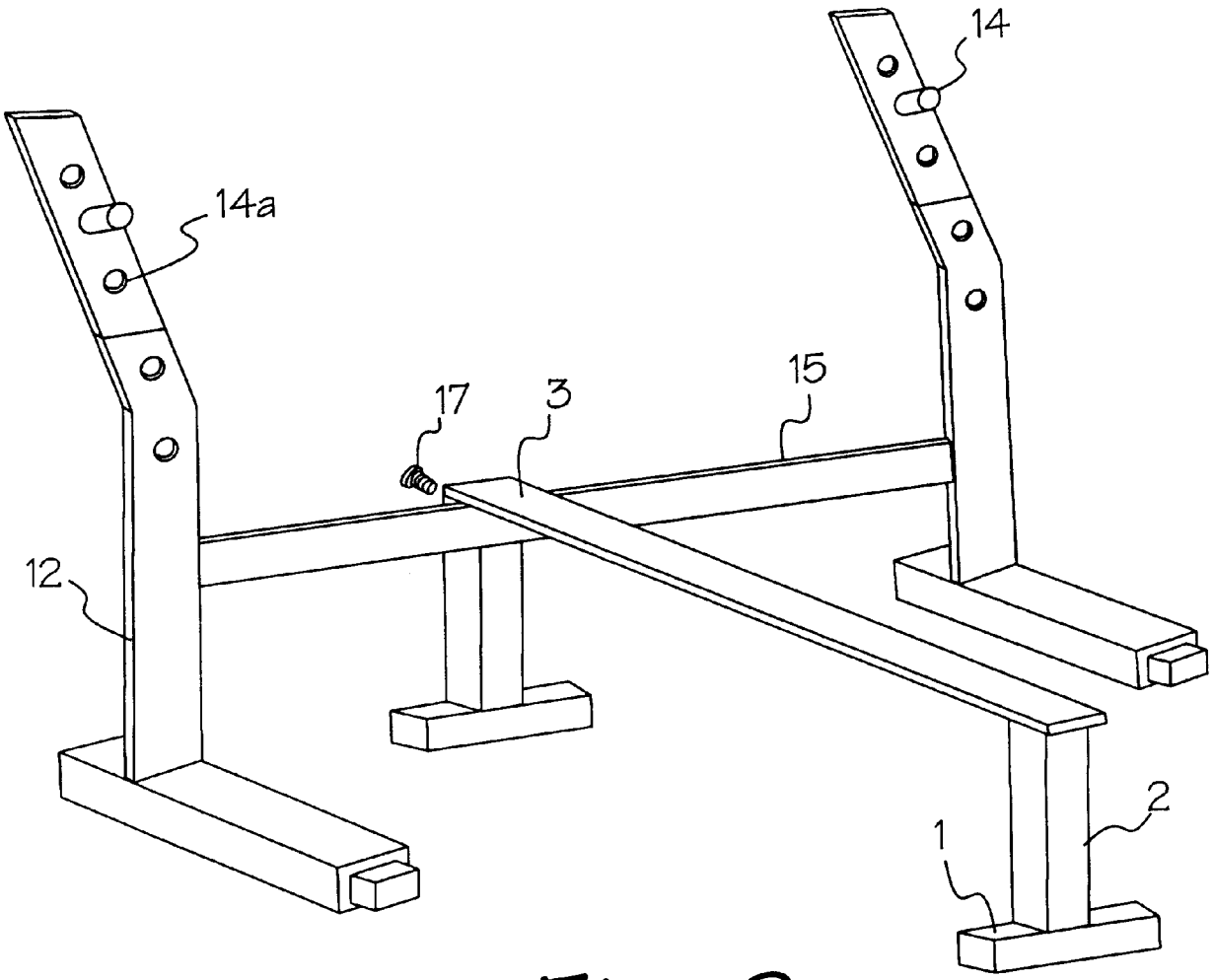
FIG. 9 shows a perspective view of just the members of the body supporting structure and the bar supporting structure fastened together.

One method of connecting the body supporting structure to the bar supporting structure is shown in FIG. 4. The bar supporting, structure is slid so that the traversing member of the bar supporting structure is engaged with securing member 16 that is attached to the bench adjacent to the traversing member of the body supporting structure. A second method for connecting the bar supporting structure to the body supporting structure is shown in FIG. 4*a*. The body supporting structure is lifted over bar traversing member 15 so that body vertical support 2 is adjacent to bar traversing member 15. Then fastener 17 is rotated by hand to secure the two structures together. A perspective view of the body supporting structure connected to the bar supporting structure using this method is illustrated in FIG. 9. A third method of connecting the body supporting structure to the bar supporting structure is shown in FIG. 4*b*. Fastener 17 is inserted through vertical support 2 of the body supporting structure and secured into bar traversing member 15 of the bar supporting structure. The fastener in FIG. 4*b* is not tightened by hand while the fastener in FIG. 4*a* may be hand tightened. Any of the above methods, allows a user to quickly secure the transformable sofa into a bench press configuration. It should be understood that how the body supporting structure is connected to the bar supporting structure is not critical to the invention. The fastener could also be used to penetrate bar traversing member 15 before being secured into vertical support 2 of the body supporting structure.

Figure 5:
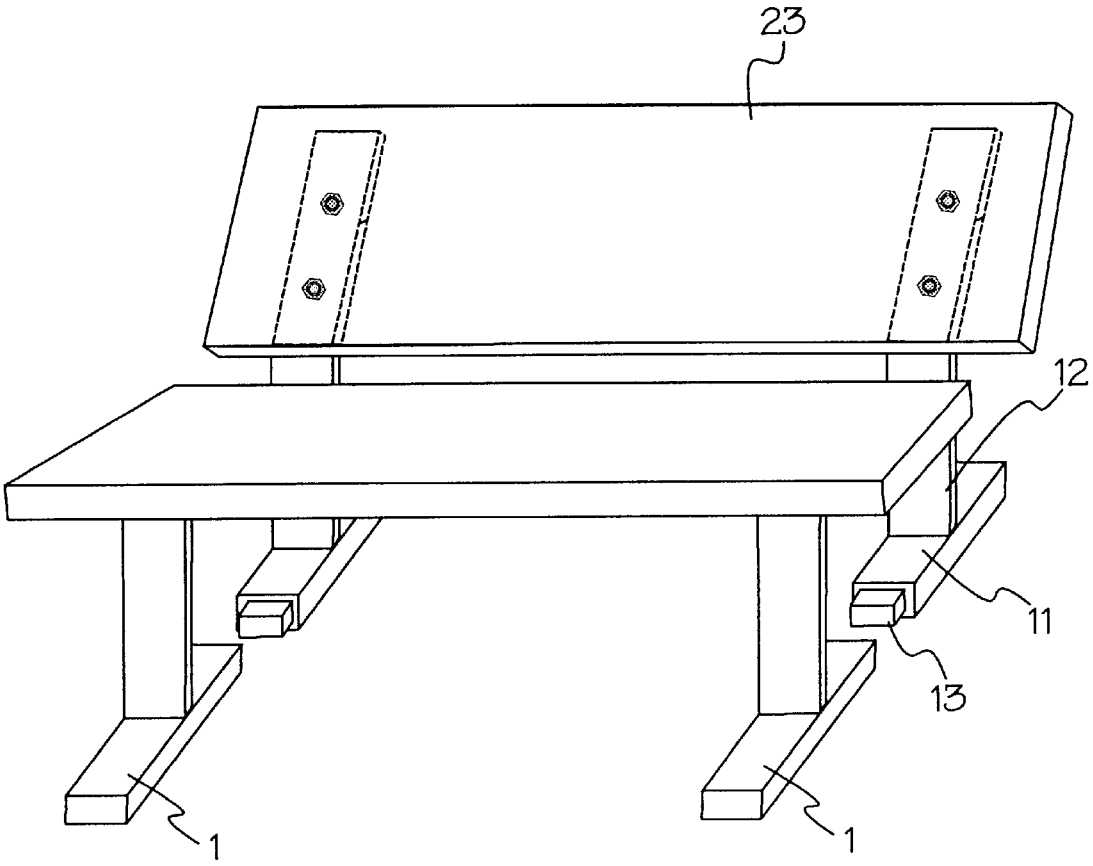
FIG. 5 is a perspective view showing the bench press of FIG. 1 and a sit up board about to form a sofa.

FIG. 5 shows the bench press along with sit up board 21 mostly transformed into a sofa Sit-up board 21 is attached to bar vertical supports 12. The sit-up board 23 can be attached to the bar supporting structure by using bolts, that can be attached to the back of a sit up board, or by using straps or clips that are attached to the back of the sit-up board to engage the bar vertical supports. Projections 13 on bases 11 are lined up with hollows (not shown) in members 1 to connect the bar supporting structure to the side of the body supporting structure. In this orientation, with the attachment of a sit-up board, the bench press has been converted to a sofa that can be enjoyed when the bench press is not being, used for resistance exercises.

Figure 6:
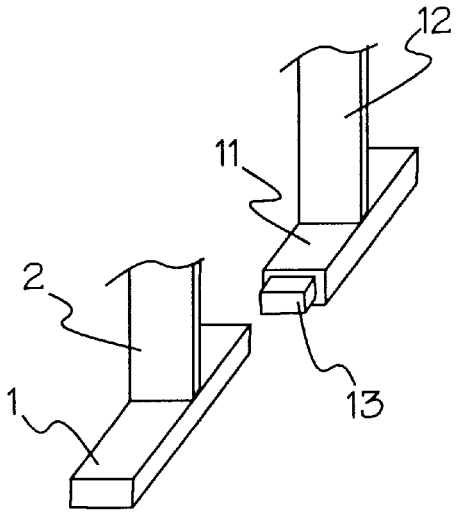
FIG. 6 is a perspective view of a base member of the bar supporting structure about to join with a base member of the body supporting structure.
Figure 6B:
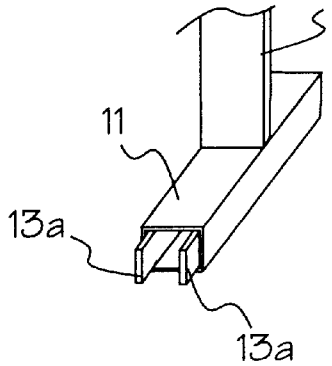
FIG. 6*b* is a perspective view of another connector that can be used between the bar supporting structure and the body supporting structure.
Figure 6A:
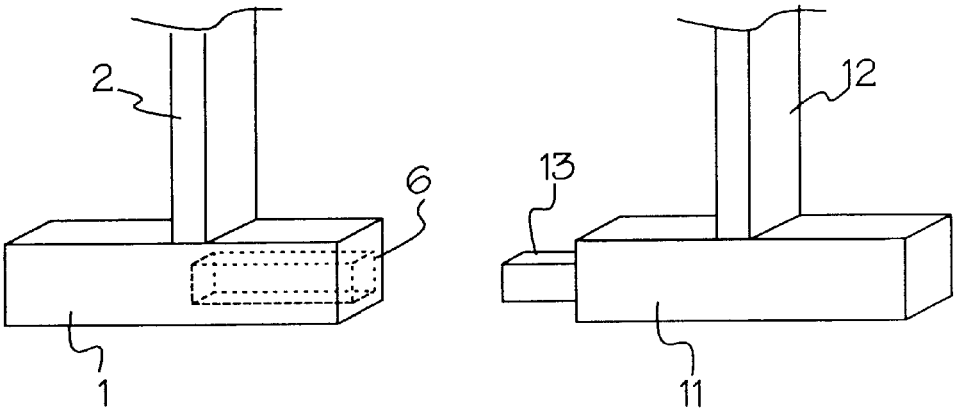
FIG. 6*a* is a side view of a base member of the bar supporting structure about to join with a base member of the body supporting structure.

FIG. 6 shows base 1 of the body supporting structure aligned to receive projection 13 of the bar supporting structure. FIG. 6*a* shows another view of the two bases about to engage each other. Projection 13 is insertable into hollow 6 in base 1 of the body supporting structure. FIG. 6*b* illustrates a differently shaped projection 13*a* from that displayed in FIG. 6. Projection 13*a* is comprised of blades perpendicular to the supporting surface underneath the bench press. Projections 13 protrude from base 11 and are insertable into the bases of the body supporting structure.

Figure 7:
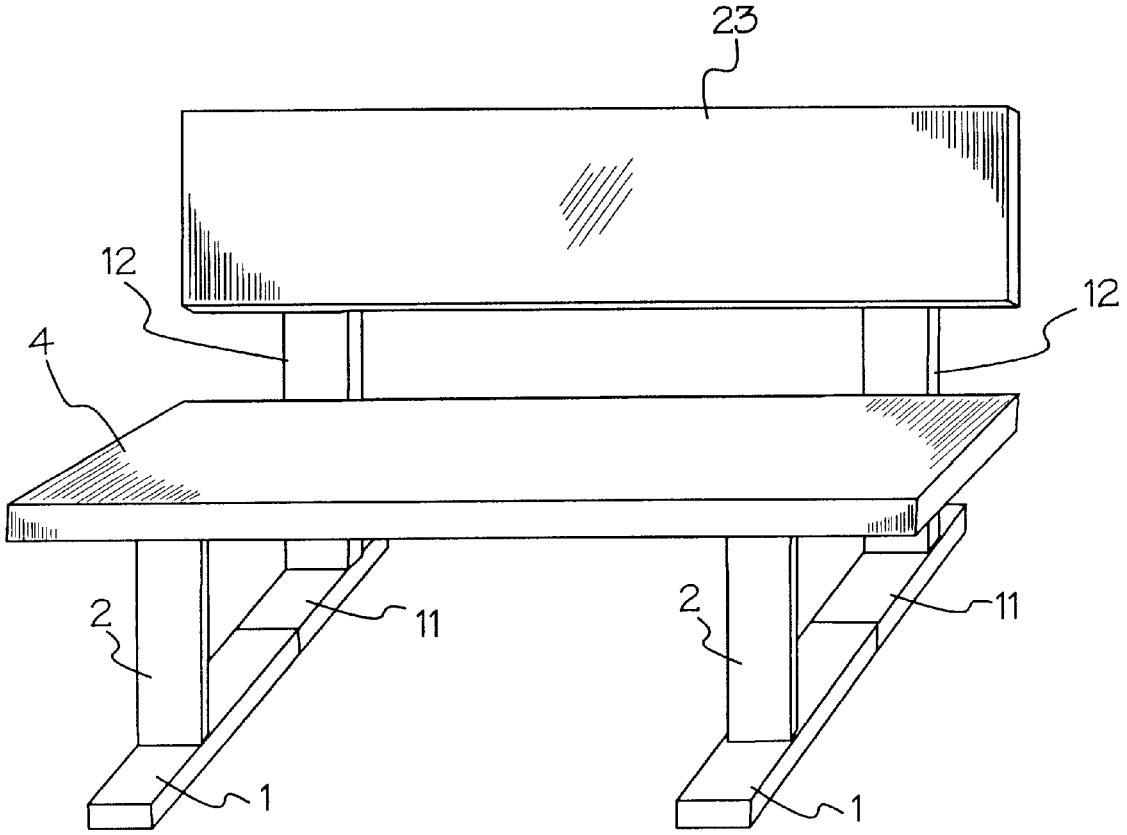
FIG. 7 shows the bench press and sit-up board transformed into a sofa.
Figure 8:
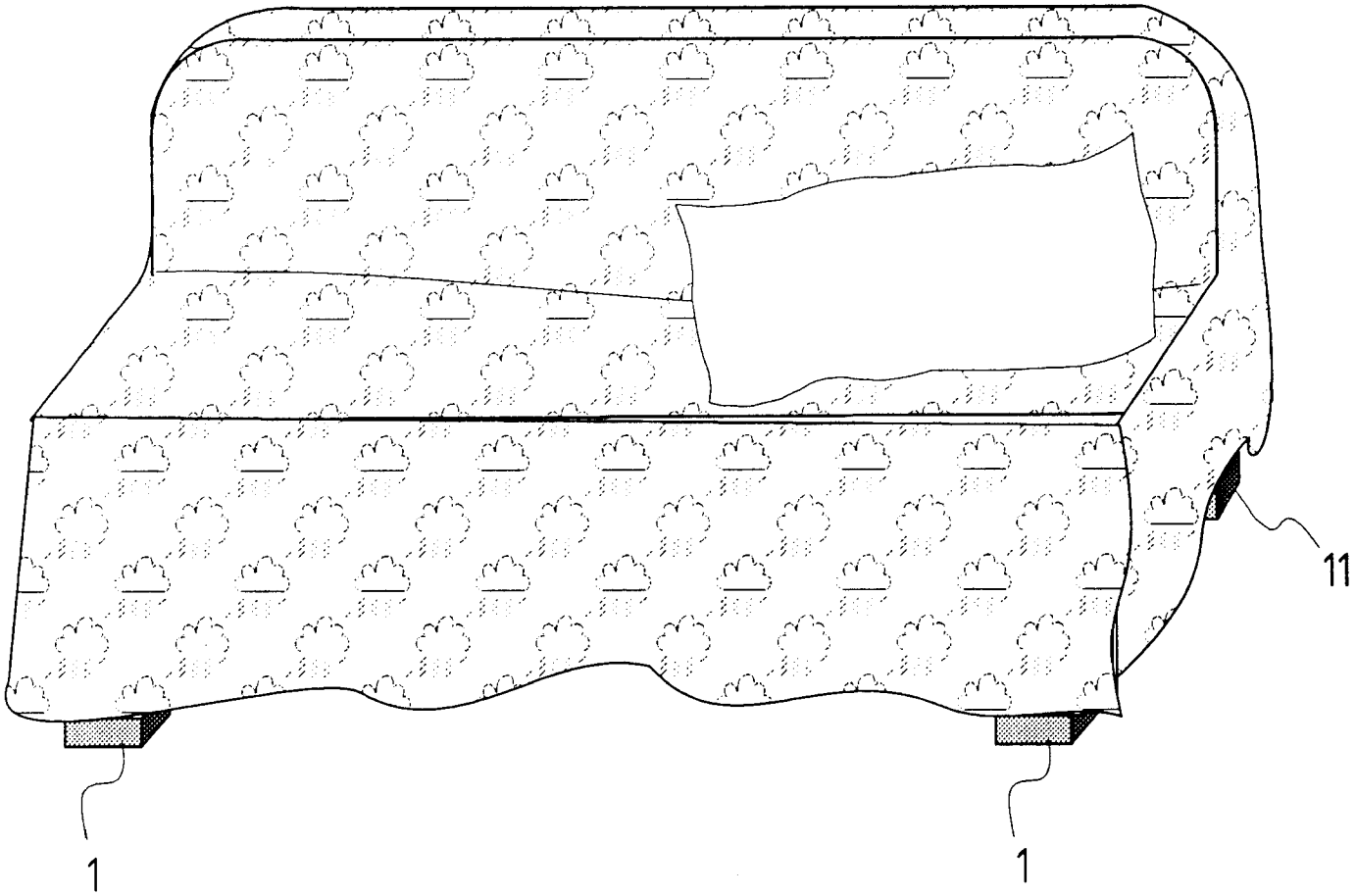
FIG. 8 shows the bench press and sit-up board transformed into a sofa with a throw draped over it along with throw pillows.

A bench press that has been fully transformed into a sofa is shown in FIG. 7. Bases 11 of bar supporting structure are fully engaged with bases 1 of the body supporting structure. Situp board 23 is attached to bar vertical supports 12 forming the backrest of the sofa. Once transformed the bench press can be adorned with a throw and throw pillows to give it a more aesthetic look, as shown in FIG. 8. Bases 1 of the body supporting structure are shown underneath the throw along with base 11 of the bar supporting structure. In addition, customized Velcro covers can be attached to the sofa to further enhance the aesthetics. Furthermore, one can have extra cushions or cushioning that is added to the bench press during the transformation to a sofa. This inventive bench press can blend in with any decor necessary through the use of accessories to allow one to keep a bench press in the home while avoiding wasting precious space.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. For example, it should be understood that a bench press can have four supports holding up a board, rather than two. Furthermore it is common to use circular metal tubing, as well as rectangular metal tubing to build bench presses.

What is claimed is:

1. An exercise device transformable from a bench press to a sofa, comprising:

a bench comprising a cushioned board supported by two vertical members, each of said two vertical members having a base, said two vertical members and each said base being constructed of metal tubing, said base positioned perpendicular to both said two vertical members and to the length of said cushioned board;

a bar support constructed of metal tubing and comprising of two vertical pillars connected by a traversing member to form an H-shaped construct, said bar support having two bases constructed of metal tubing and positioned perpendicularly to the plane of said H-shape construct;

each said base of said bench having a recess in a side parallel to the length of said bench;

a projection protruding from a distal end of each of said two bases of said bar support;

a sit-up board attachable to said two vertical pillars of said bar support to form a backrest;

said bar support positionable with said projections at a distal end of said bench to form a bench press; and said bar support positionable facing a long side of said bench, said projections on said two bases of said bar support being insertable into said recess in each said base of said bench, and said sit-up board attachable to said two vertical pillars of said bar support to transform said bench press into a sofa.

2. The exercise device of claim 1, with said two vertical pillars of said bar support each having, at least one weight bearing arm.

3. The exercise device of claim 1, further comprising a plurality of padding and material attached using any one of Velcro, straps, and ties to further enhance the aesthetics of said sofa.

4. The exercise device of claim 1, further comprised of said projection on said second plurality of bases having a square shaped cross-section.

5. The exercise device of claim 1, further comprised of said hollows in said first plurality of bases having a square cross-section.

6. The exercise device of claim 1, further comprised of said bench having a body traversing member reinforcing said cushioned board and attached to said two vertical members.

7. The exercise device of claim 1, further comprised of said sit-up board having either one of straps and clips mounted on a rear side for attaching said sit-up board to said two vertical bar supports.

8. A bench press and a sit-up board transformable into a sofa, comprising:

a body supporting structure comprising a weight bench having a rectangular shape and having a first plurality of bases, each of said first plurality of bases containing a hollow oriented perpendicularly to the length of said weight bench;

a bar supporting structure having two vertical pillars each supported by one of a second plurality of bases having a projection that can be engageably inserted into said hollow of one of said first plurality of bases, said two vertical members being connected by a traversing member;

means for connecting said body supporting structure and said bar supporting structure to form a bench press;

means for said sit up board to be attached to said bar supporting structure; and said projection from each of said second plurality of bases of said bar supportingly structure being insertable into said hollow of each of said first plurality of bases of said body supporting structure and said sit up board attachable to said two vertical pillars of said bar supporting structure to transform said bench press into said sofa.

9. The bench press of claim 8, with said body supporting structure further comprising:

a cushioned board fastened to a body traversing member;

at least two vertical columns supporting said body traversing member; and said first plurality of bases supporting, said at least two vertical columns.

10. The bench press of claim 8, further comprised of said body supporting structure and said bar supporting structure constructed of rectangular metal tubing.

11. The bench press of claim 8, with said bar supporting structure further comprising:

two vertical pillars each having a weight bearing arm; and said second plurality of bases supporting said two vertical pillars.

12. The bench press of claim 11, further comprised of said two vertical pillars each having a second weight bearing arm.

13. The bench press of claim 8, further comprising a plurality of padding and material attached using any one of Velcro, straps, and ties to further enhance the aesthetics of said sofa.

14. The bench press of claim 8, further comprised of said means for connecting said body supporting structure and said bar supporting structure comprising sliding said traversing member of said bar supporting structure under said cushioned board of said body supporting structure and positioning said traversing member adjacent to a distal end of said body traversing member of said body supporting structure.

15. The bench press of claim 8, further comprised of said projection on said second plurality of bases having a square shaped cross-section.

16. The bench press of claim 8, further comprised of said hollows in said first plurality of bases having a rectangular cross-section.

17. An exercise device transformable from a bench press to a sofa, comprising:

a bench comprising a board supported by two vertical pillars each having a base, said two vertical members and each said base being constructed of metal tubing, said base positioned perpendicular to both said two vertical pillars and to the length of said board;

a bar support constructed of metal tubing and comprising two vertical columns connected by a traversing member to form an H-shape construct, said bar support having two bases constructed of metal tubing and positioned perpendicularly to the plane of said H-shape construct, said two vertical columns each having at least one weight bearing arm;

each said base of said bench having a cavity in a side parallel to the length of said bench;

said two bases of said bar support each having a projection protruding from a distal end of said bases;

a sit-up board having either one of clips or straps on a rear side for attaching said sit-up board to said two vertical columns to form a backrest;

said bar support positionable with said projections at a distal end of said bench to form a bench press; and said bar support positionable facing a long side of said bench, said projections on said two bases of said bar support being insertable into said cavity in each said base of said bench, and said sit-up board attachable to said two vertical columns of said bar support to transform said bench press into a sofa.

18. The exercise device of claim 17, further comprising a plurality of padding and material attached using any one of Velcro, straps, and ties to further enhance the aesthetics of said sofa.

19. The exercise device of claim 17, further comprised of said projection on said second plurality of bases having a square shaped cross-section.

20. The exercise device of claim 17, further comprised of said cavity in each of said first plurality of bases having a square cross-section.

21. The exercise device of claim 17, further comprised of said bench having a body traversing member reinforcing said board and attached to said two vertical members.

22. A bench press transformable into a sofa, comprising:

said bench press comprising a weight bench and a bar stand;

said bar stand supporting a weight bearing bar and being attachable to said weight bench, said bar stand comprising a first base structure supporting said bar stand and having two projecting beams; and said weight bench having a second base structure supporting said weight bench, said weight bench comprising:

two cavities in said second base structure being engageable with said two projecting beams of said first base structure of said bar stand to form a sofa; and a U-shaped body attached to an underside of said weight bench being engageable with said first base structure to form said bench press.

* * * * *